US005238795A

United States Patent [19]

Metoki

[11] Patent Number: 5,238,795

[45] Date of Patent: Aug. 24, 1993

[54] LIGHT-SENSITIVE SILVER HALIDE PHOTOGRAPHIC MATERIAL

[75] Inventor: Iku Metoki, Hino, Japan

[73] Assignee: Konica Corporation, Tokyo, Japan

[21] Appl. No.: 736,245

[22] Filed: Jul. 26, 1991

[30] Foreign Application Priority Data

Aug. 8, 1990 [JP] Japan ..... 2-210867

[51] Int. Cl.[5] ..... G03C 1/46

[52] U.S. Cl. ..... 430/502; 430/509; 430/966; 430/139; 430/627; 430/628; 430/642; 430/640

[58] Field of Search ..... 430/509, 966, 139, 627, 430/628, 642, 640, 502

[56] References Cited

U.S. PATENT DOCUMENTS

| | | | |
|---|---|---|---|
| 3,271,158 | 9/1966 | Allentoff et al. | 430/268 |
| 3,923,515 | 12/1975 | van Stappen | 430/509 |
| 4,917,993 | 4/1990 | Mukunoki et al. | 430/966 |
| 4,994,355 | 2/1991 | Dickerson et al. | 430/509 |
| 4,997,750 | 5/1991 | Dickerson et al. | 430/509 |
| 5,021,327 | 6/1991 | Bunch et al. | 430/966 |

FOREIGN PATENT DOCUMENTS

| | | |
|---|---|---|
| 0126644 | 11/1984 | European Pat. Off. . |
| 0259855 | 3/1988 | European Pat. Off. . |
| 0345483 | 12/1989 | European Pat. Off. . |
| 384633 | 8/1990 | European Pat. Off. . |
| 0437117 | 7/1991 | European Pat. Off. . |

OTHER PUBLICATIONS

*Research Disclosure*, No. 184, Aug. 1979, Item 18431, pp. 433–441, "Radiographic Films/Materials", J. W. Carpenter, GB.

*Research Disclosure*, No. 17643, Dec. 1978, Class 1X, p. 26, "Vehicles and Vehicle Extenders", J. W. Carpenter, GB.

*Primary Examiner*—Charles L. Bowers, Jr.
*Assistant Examiner*—Thomas R. Neville
*Attorney, Agent, or Firm*—Jordan B. Bierman

[57] ABSTRACT

A light-sensitive silver halide photographic material is disclosed. The light-sensitive material comprises a support and two photographic layers each being provided on both sides, side A and side B, of the support and comprising a silver halide emulsion layer and a hydrophilic colloid layer wherein the light-sensitive material satisfies the relationship between sensitivities sA, sB and sA' thereof represented by the following expressions I and II, and an organic substance remained in the photographic layers after processing is an amount of not more than 90% by weight of the organic substance contained in the photographic layers before processing of the light-sensitive material;

I: $sA/sA' > 4.0$

II: $sA/sB = 1.5$ to 20 wherein sA is sensitivity to light of the photographic layers provided on the side A of the support, when exposure is carried out only from the side A, and sB and sA' are sensitivities to light the photographic layers provided on the sides B and A of the support, respectively, when exposure is carried out only from the side B. The light-sensitive material is improved in the sensitivity, sharpness, fixing ability and dependency on developing conditions thereof.

5 Claims, No Drawings

LIGHT-SENSITIVE SILVER HALIDE PHOTOGRAPHIC MATERIAL

FIELD OF THE INVENTION

The present invention relates to a light-sensitive silver halide photographic material having an improved sensitivity or speed, sharpness and fixing performance, and also having less processing temperature dependence. More particularly, it relates to a light-sensitive silver halide photographic material for medical use.

BACKGROUND OF THE INVENTION

In recent years, light-sensitive silver halide photographic materials are required to have higher-level photographic performances such as a higher speed, a better graininess, a higher sharpness and a higher covering power. To cope with such requirements, for example, a variety of complicated technical means as exemplified by the controlling of crystal habits of silver halide crystals per se, grain size distribution, or iodine concentration distribution in each grain have been studied and put into practical use.

In particular, in light-sensitive silver halide photographic materials for medical use, the sharpness of images obtained after development is considered very important since it is necessary to accurately find out a minute nidus to make a diagnosis on a higher level. For example, Japanese Patent Publications Open to Public Inspection hereinafter referred to as "Japanese Patent O.P.I. Publication(s)") No. 28827/1975, No. 185038/1982, No. 158430/1989, etc. disclose that a water-soluble dye is incorporated into a photosensitive layer and/or a layer or layers adjacent thereto so that the sharpness can be improved. Such conventional methods, however, are disadvantageous in that they can not achieve the speed and sharpness at the same time, where an improvement in sharpness results in a decrease in speed. Thus, it has been strongly sought to develop a technique by which the sharpness can be increased without a decrease in speed so that an improved diagnosis can be made.

As a means for improving the processing performance of light-sensitive materials, it is commonly considered effective, for example, to increase the proportion of silver quantity by decreasing the amounts of gelatin or synthetic polymeric compounds used as a binder of silver halide grains, or decrease the amount of a hardening agent.

These methods, however, are accompanied with the disadvantages that they may cause a poor photographic performance such as an increase in fog or a deterioration of graininess and sharpness, and may make poor the physical properties of light-sensitive silver halide photographic materials, as exemplified by scratch resistance, peel-off resistance and pressure resistance. Hence, they can not be said to be preferable methods.

Under such circumstances, it has been strongly sought to provide a light-sensitive silver halide photographic material having an improved speed, sharpness and fixing performance in rapid processing, and also having less development temperature dependence.

SUMMARY OF THE INVENTION

A first object of the present invention is to provide a high-speed light-sensitive silver halide photographic material for medical use, having an improved sharpness and enabling an improved diagnosis.

A second object of the present invention is to provide a light-sensitive silver halide photographic material for medical use, having less processing temperature dependence even in rapid processing carried out using an automatic processor, being free from poor fixing and having a high speed and high sharpness.

The above objects of the present invention can be achieved by a light-sensitive silver halide photographic material comprising a support and provided on its both sides, side A and side B, each a photographic layer comprising a silver halide emulsion layer and a hydrophilic colloid layer, wherein the light-sensitive material has a relationship between sensitivities sA, sB and sA' represented by the following expressions I and II;

I: $sA/sA' > 4.0$

II: $sA/sB = 1.5$ to 20 wherein sA is sensitivity to light of the photographic layers of the side A, when light is given on the photographic layer of side A, and sB and sA' are sensitivities to light the photographic layers of the side B and side A, respectively, when light is given on the photographic layer of side B: and an organic substance remaining in the photographic layers after processing is in an amount of not more than 90% by weight of the organic substance contained in the photographic layers before processing of the light-sensitive material.

DETAILED DESCRIPTION OF THE INVENTION

The present invention will be described below in detail.

In the present invention, the sensitivity or speed of the light-sensitive silver halide photographic material refers to a value obtained by the following method.

(1) Exposure conditions:

(1)-1 Fluorescent intensifying screen used (variable depending on the wavelength to which a film used is sensitive):

(A) In the case of a light-sensitive material having a sensitivity to the blue region (i.e., Reg. material), a fluorescent intensifying screen mainly composed of $CaWO_4$, as exemplified by NR Series available from Konica Corporation.

(B) In the case of a light-sensitive material having a sensitivity to the green region (i.e., Ortho. material), a fluorescent intensifying screen mainly composed of Tb-activated $Gd_2O_2S$, as exemplified by KO Series available from Konica Corporation.

(1)-2 X-ray irradiation conditions:

Tube pressure: 70 kVp

Grid: not used

Tube current: 100 mA

Time: 100 msec.

Distance: 1.85 m (1)-3 Exposure method:

The intensifying screen is placed only on the back side, i.e., the side farther from the X-ray source, of a cassette, and a sample (film) is superposed thereon so that the side to be exposed is contacted with the screen, followed by exposure through an aluminum step under conditions (1)-2 described above.

(2) Processing:

Developing solution:

XD-SR (available from Konica Corporation)

Developing temperature: 35° C.

Fixing solution.

XF-SR (available from Konica Corporation)

Fixing temperature: 33° C.

Processor:

SRX-501 (manufactured by Konica Corporation)

(3) Sensitivity measurement method:

On a sample having been processed, the layer of the side B of a sample exposed only on the side A is removed for the purpose of measuring the sensitivity sA. Subsequently, a sample exposed only On the side B is divided into tow pieces, from one of which the photographic layer of the side B is removed for the purpose of measuring the sensitivity sA', and from the other of which the layer of the side A is removed for the purpose of measuring the sensitivity sB. From the characteristic curves of the resulting four kinds of samples, reciprocals of the amounts of exposure, given to the surface of the sample to form a density of base density + fog density + 1.0, are determined to give sA, sB and sA'.

In the cases of the light-sensitive materials having sensitivities to the red region and the infrared region, the methods of exposure vary depending on the respective light-sensitive materials.

The light-sensitive silver halide photographic material according to the present invention has a relationship between sensitivities on the side A and side B, of $sA/sA' > 4.0$, preferably $\geqq 4.5$, and more preferably $\geqq 5.0$.

The relationship of sensitivities sA/sB is 1.5 to 20, and preferably 1.5 to 10.

As methods of making differences in sensitivity between the emulsions for the side A and that for the side B, various methods can be applied, as exemplified by a method in which grains with a smaller grain size is used as silver halide grains on the side B or a method in which the ratio of composition of silver halide grains used in the side B is controlled to be of small-grain majority.

The light-sensitive material thus obtained contains in its component layers, organic substances such as a binder of silver halide grains, as exemplified by gelatin, synthetic polymeric substances, a matting agent, a plasticizer and other various kinds of photographic additives.

In the present invention, it has been discovered that the objects and effects of the present invention ca be desirably obtained by controlling these organic substances present in photographic layers after processing to flow out in an amount not less than 10%, and preferably not less than 15% and not more than 30%, of the amount of the organic substances used, as a result of processing.

For this purpose, it is preferable that at least one layer included in the photographic layers contains an organic substance capable of flowing out from the layer during the processing of the light-sensitive material.

The flowing-out of the organic substances is usually the flowing-out thereof by their dissolution during processing. For example, the organic substances include gelatin or gelatin derivatives and synthetic polymeric substances having not reacted with a hardening agent.

In the present invention, the organic substances that may flow out specifically include gelatin, gelatin derivatives such as phthalated gelatin and acetylated gelatin, saccharides such as dextran, sucrose and pullulan, and also synthetic polymeric substances such as polyvinyl alcohol, polyvinyl pyrrolidone, polyacrylic acid and polyacrylamide.

Particularly preferred ones among these are dextran, polyacrylic acid and polyacrylamide. These compounds may have an average molecular weight of not more than 80,000, and preferably not more than 40,000.

The layer or layers containing these organic matters may be any one or both of emulsion layers and hydrophilic colloid layers such as a protective layer. It is more preferred for the organic substances to be contained in a layer or layers near to the surface of the light-sensitive material, from which they can more readily flow out. The coating weight of the flow-out organic substance is preferably 0.1 to 2.0 $g/m^2$, more preferably 0.2 to 1.2 $g/m^2$.

The amount of the organic substance flowed out from an emulsion layer and/or another layer in the course of development, fixing and washing can be measured by analyzing processing solutions or by measuring layer thickness before and after processing. In the present invention, it is determined by weight measurement.

More specifically, a film sample having not been processed is left to stand under conditions of a temperature of 25° C. and a relative humidity of 10%, and its weight is measured after its water content has come to equilibrium. After the sample has been subsequently subjected to developing, fixing and washing by the use of an automatic processor and then dried, its weight is again measured by the same method for its weighing before processing. Percentage of the organic substances remaining after flowout is obtained from the weight ratios of the sample weighed before and after processing.

The weight of the support and a weight decrease due to silver halide grains are previously calculated. Percentage of the remaining organic substances is calculated by subtracting these values.

The light-sensitive silver halide photographic material according to the present invention is usually processed using an automatic processor of a roller transport type. The developing solution used in the automatic processor may be any known developing solution containing as developing agents dihydroxybenzenes including hydroquinone, 1-phenyl-3-pyrazolidone, or aminophenols, as well as an alkali agent, a preservative, antifoggant, a hardening agent, a chelating agent and a surface active agent.

The fixing solution may also be any of those usually used, including, for example, an acid hardening fixer comprised of a thiosulfate as a fixing agent and sodium sulfite as a preservative.

Development temperature may be in the range of 25° C. to 50° C., and preferably 30° C. to 45° C. Development time may preferably be 8 seconds to 40 seconds, and particularly 8 seconds to 25 seconds. As to the total processing time, the light-sensitive material according to the present invention may preferably be processed in 25 seconds to 200 seconds, and particularly 30 seconds to 100 seconds throughout the steps of developing, fixing, washing and drying.

The hydrophilic colloid layers referred to in the present invention mean hydrophilic layers provided on light-sensitive silver halide photographic materials, and mean a variety of layers containing binder components including gelatin, as exemplified by a silver halide emulsion layer, a protective layer, an antihalation layer, a filter layer, a development control layer, an ultraviolet absorbing layer and an under-coat layer that are necessary for light-sensitive photographic materials.

In a most preferred embodiment of the present invention, a polyethylene terephthalate film support having been subjected to subbing on its both sides is provided on its one side, as the side A, with a high-speed silver halide emulsion layer and provided on this layer with a protective layer containing gelatin as a binder component.

Subsequently, on the opposite side thereof, as the side B, the support is provided with a low-speed silver halide emulsion layer having a different speed.

The emulsion used in the light-sensitive silver halide photographic material of the present invention may comprise any silver halide such as silver iodobromide, silver iodochloride or silver iodochlorobromide. It may preferably comprise silver iodobromide in view of the advantage that a light-sensitive material with a particularly high speed can be obtained.

Silver halide grains contained in the photographic emulsion may be any of those having grown in an entirely isotropic form such as cubes, octahedrons or tetradecahedrons, those of a polyhedral crystal form such as spheres, those comprised of twinned crystals having a plane defect, or those having a mixed or composite form of any of these. These silver halide grains may have a grain size of from as mall as 0.1 μm or less to as large as 20 μm.

The emulsions used in the light-sensitive silver halide photographic material of the present invention can be prepared by known methods. For example, they can be prepared by the methods disclosed in Emulsion Preparation and Types, Research Disclosure (RD) No. 17643, December 1978, pp.22–23, and in RD No. 18716, November 1979, p.648.

As a preferred embodiment of the present invention, the emulsion is a monodisperse emulsion comprising silver iodide localized in the inside of a grain. The monodisperse emulsion herein referred to is comprised of silver halide grains at least 95% of which are within ±40%, and preferably within ±30%, of average grain size, in terms of grain number or weight when, for example, average grain diameter is measured by a conventional method. With regard to the grain size distribution of the silver halide, the emulsion may be of any of a monodisperse emulsion having a narrow distribution or a polydisperse emulsion having a broad distribution.

As to the crystal structure of the silver halide, the grain may have silver halide composition different in its inside and outside. An emulsion as a preferred embodiment of the present invention is a core/shell monodisperse emulsion with a clear double-layer structure comprised of a core having a high iodine concentration and a shell having a low iodine concentration.

The core having a high iodine concentration may preferably have a silver iodide content of 20 mol % to 40 mol %, and particularly preferably 20 mol % to 30 mol %

Such a monodisperse emulsion can be prepared by known methods, which are disclosed, for example, in J. Phot. Sic. 12. pp.242–251, Japanese Patent O.P.I. Publications No. 36890/1973, No. 16364/1977, No. 142329/1980 and No. 49938/1983, British Patent No. 1,413,748, and U.S. Pat. Nos. 3,574,628 and 3,655,394.

The above monodisperse emulsion may particularly preferably be an emulsion wherein grains have been grown by using seed crystals and feeding silver ions and halide ions while this seed crystals are made to serve as growth nuclei. The core/shell emulsion can be obtained by the methods disclosed in detail, for example, in British Patent No. 1,027,146, U.S. Pat. Nos. 3,505,068 and 4,444,877, and Japanese Patent O.P.I. Publication No. 14331/1985.

The silver halide emulsion used in the present invention may be comprised of tabular grains having an aspect ratio of not less than 2.

Such tabular grains are advantageous in that the efficiency of spectral sensitization can be improved and the graininess and sharpness of an image can be improved. They can be prepared by the methods disclosed, for example, in British Patent No. 2,112,157, and U.S. Pat. Nos. 4,439,520, 4,433,048, 4,414,310 and 4,434,226.

The emulsion described above may be any emulsions of a surface latent image type in which a latent image is formed on the surfaces of grains, an internal latent image type in which a latent image is formed in the insides of grains, or a type in which a latent image is formed on the surfaces and insides. In these emulsions, a cadmium salt, a lead salt, a zinc salt, a thallium salt, an iridium salt or a complex salt thereof, a rhodium salt or a complex salt thereof, an iron salt-or a-complex salt thereof, or the like may be used at the stage where physical ripening is carried out or grains are prepared. In order to remove soluble salts, the emulsions may be subjected to washing such as noodle washing, flocculation sedimentation or ultrafiltration. Preferred methods of washing are exemplified by a method making use of an aromatic hydrocarbon aldehyde resin as disclosed in Japanese Patent Examined Publication No. 16086/1960 and a method making use of a high-molecular flocculating agent, exemplary agents G3, G8, etc., as disclosed in Japanese Patent O.P.I. Publication No. 158644/1988, which are particularly preferred desalting methods.

In the emulsion according to the present invention, various photographic additives can be used in the step anterior or posterior to physical ripening or chemical ripening. Known additives may include the compounds as disclosed in, for example, Research Disclosures No. 17643 (December 1978) and No. 18716 (November 1979).

The emulsions are coated on both sides of a support. The coating weight of the emulsion having a higher speed coated on side A of the support is preferably not more than 4.0 g/m$^2$, and more preferably 1.0 to 3.5 g/m$^2$, in terms of silver, and that of the emulsion having a lower speed coated on side B of the support is preferably not more than 3.0 g/m$^2$, and more preferably 0.1 to 2.5 g/m$^2$, in terms of silver.

Coating amounts of gelatin in the emulsion layer and the protective layer each may be the same or different on the side A and side B, respectively. The coating amount of gelatine in the emulsion layer is preferably 0.8 to 4.0 g/m$^2$, more preferably 1.5 to 2.5 g/m$^2$. The coating amount of gelatin in the protective layer is preferably 0.1 to 2.5 g/m$^2$, more preferably 0.5 to 1.5 g/m$^2$.

The support that can be used in the light-sensitive material according to the present invention may include, for example, the supports as described in RD-17643, page 28, and RD-18716, page 647, left column.

Suitable supports may include plastic films. The surfaces of these supports may commonly be provided with a subbing layer or subjected to corona discharging or ultraviolet irradiation so that the adhesion of coating layers can be improved. Then the support thus treated can be coated on one side or both sides thereof with the emulsion according to the present invention.

The present invention can be applied to all light-sensitive silver halide photographic materials, but is particularly suited for high-speed black and white light-sensitive materials.

In instances in which the present invention is applied to medical X-ray radiography, a fluorescent intensifying screen is used which is mainly composed of a fluorescent substance that emits near ultraviolet light or visible light as a result of exposure to transmitting radiations. This screen should preferably be brought into close contact with each side of a light-sensitive material coated on its both sides with the emulsion of the present invention, and then exposed to X-rays.

The transmitting radiations herein referred to are electromagnetic waves with a high energy, and are meant to be X-rays and gamma rays.

The fluorescent intensifying screen also refers to, for example, an intensifying screen mainly composed of calcium tungstate as a fluorescent component, or a fluorescent intensifying screen mainly composed of a rare earth compound activated with terbium.

EXAMPLES

The present invention will be described below by giving Examples. The present invention are by no means limited by the following Examples.

EXAMPLE 1

Using, as nuclei, monodisperse grains of silver iodobromide having an average grain size of 0.2 μm and containing 2.0 mol % of silver iodide, silver iodobromide grains containing 30 mol % of silver iodide were grown under conditions of pH 9.3 and pAg 7.5. Thereafter, potassium bromide and silver nitrate were added in equimolar amounts under conditions of pH 7.8 and pAg 8.9. Monodisperse emulsions each comprising grains with an average grain size of 1.20 μm (A), 0.70 μm (B) or 0.40 μm (C) were thus prepared so as to give silver iodide grains having an average silver iodide content of 2.3 mol %.

Next, the emulsions thus obtained were each subjected to desalting using a conventional flocculation process to remove excessive salts. More specifically, the desalting was carried out in the same manner as the method of desalting seed crystals as disclosed in Japanese Patent O.P.I. Publication No. 172152/1988.

Monodisperse emulsions each comprising grains with an average grain size of 1.2 μm (D), 0.7 μm (E) or 0.4 μm (F) were also prepared in the same manner as the method disclosed in Japanese Patent O.P.I. Publication No. 52137/1989. Here, 300 mg/mol·AgX of a spectral sensitizing dye (1) set out later was added after completion of grain growth described in Japanese Patent O.P.I. Publication No. 52137/1989.

Next, the resulting emulsions were subjected to spectral sensitization and chemical sensitization. More specifically, spectral sensitizing dyes (1) and (2) were added to the emulsions (A), (B) and (C) each in weight ratio of 200:1 and in a total amount of 600 mg/mol·AgX. In regard to the emulsions (D), (E) and (F), they were added each in weight ratio of 100:1 and in a total amount of 300 mg/mol·AgX. Thereafter, $3.6\times10^{-3}$ mol/mol·AgX of ammonium thiocyanate and optimum amounts of chloroauric acid and hypo were used to carried out chemical ripening. On the 15th minute before completion of the chemical ripening, 200 mg/mol·AgX of potassium iodide was added, and finally $2\times10^{-2}$ mol of 4-hydroxy-6-methyl-1,3,3a,7-tetrazaindene was added to make stabilization.

Using the six kinds of emulsions thus obtained, the following emulsion coating solutions were prepared.

Coating solution 1:

Emulsions (A) to (C) were mixed in a proportion of (A):(B):(C)=25:35:40.

Coating solution 2:

Emulsions (A), (B) were mixed in a proportion of (A):(B)=41.7:58.3.

Coating solution 3:

Emulsion (C)=100.

Coating solution 4:

Emulsions (D) to (F) were mixed in a proportion of (D):(E):(F)=25:35:40.

Coating solution 5:

Emulsions (D), (E) were mixed in a proportion of (D):(E)=41.7:58.3.

Coating solution 6:

Emulsion (F)=100.

To the six kinds of coating solutions thus obtained, the polymeric compound shown in Table 1, K-1, K-2 or K-3, and the emulsion additives described later were added to give coating solutions.

As a protective layer coating solution, a solution was prepared to have the composition shown below.

Each coating solution thus obtained was applied to a 175 μm thick polyethylene terephthalate base film having been subjected to subbing, simultaneously on its both sides using two sets of slide hopper type coaters so as to give the constitution as shown in Table 1, followed by drying for 2 minutes and 50 seconds to give samples Nos. 1 to 16. Coating weights of the emulsions were 3.0 g/m$^2$ on side A and 1.9 g/m$^2$ on side B in terms of silver, respectively, in samples 5 to 8 and 13 to 16. In samples 1 to 4 and 9 to 12, the coating weights of the emulsions were 2.3 g/m$^2$, in terms of silver, on both sides.

Gelatin contents of the emulsions were adjusted so that the coating weights of gelatin in the emulsion layers of side A and side B were also 2.0 g/m$^2$ in all of the samples.

The additives used in emulsion solutions were as follows. In the following, each weight is per mol of silver halide.

| | |
|---|---|
| 1,1-Dimethylol-1-bromo-1-nitromethane | 10 mg |
| t-Butylcatechol | 400 mg |
| Polyvinylpyrrolidone (molecular weight: 10,000) | 1.0 g |
| Styrene/maleic anhydride copolymer | 7.5 g |
| Trimethylolpropane | 10 g |
| Diethylene glycol | 5 g |
| Nitrophenyl-triphenyl phosphonium chloride | 50 mg |
| Ammonium 1,3-dihydroxybenzene-4-sulfonate | 4 g |
| Sodium 2-mercaptobenzimidazole-5-sulfonate | 15 mg |
| 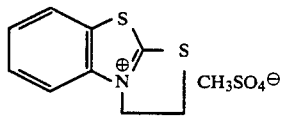 | 10 mg |
| $n\text{-}C_4H_9OCH_2CH(OH)CH_2N(CH_2COOH)_2$ | 1 g |
| 1-Phenyl-5-mercaptotetrazole | 1 mg |

The additives used in the protective layer coating solution were as follows. In the following, each weight is per mol of silver halide. The solution was coated on the both sides so as to give 1.15 g/m$^2$ of gelatin per each side.

| | |
|---|---|
| Lime-treated inert gelatin | 68 g |
| Acid-treated gelatin | 2 g |
| $NaO_3S-CH(CH_2COOC_{10}H_{21})-COOC_5H_{11}$ (a coating aid) | 1 g |
| Polymethyl methacrylate, a matting agent with an area average particle diameter of 3.5 μm | 1.1 g |
| Silicon dioxide particles, a matting agent with an area average particle diameter of 1.2 μm | 0.5 g |
| Ludox AM (available from Du Pont) (colloidal silica) | 30 g |
| 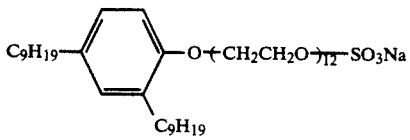 | 1.0 g |
| 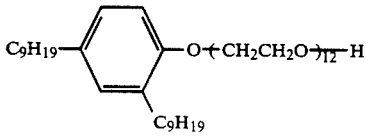 | 0.2 g |
| $C_4F_9SO_3K$ | 2 mg |
| $C_{12}H_{25}CONH(CH_2CH_2O)_5H$ | 0.5 g |
| 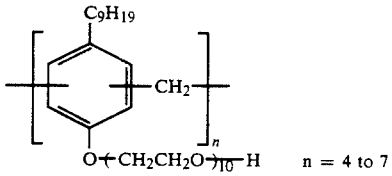 n = 4 to 7 | 1 g |
| 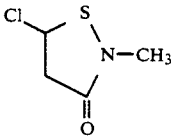 | 70 mg |
| $(CH_2=CH-SO_2-CH_2)_2O$ | 5 g |
| Spectral sensitizer (1) 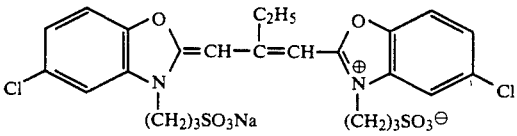 | |
| Spectral sensitizer (2) 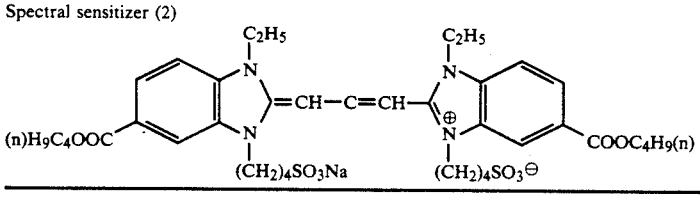 | |

Using the resulting samples, various performances were evaluated by the following methods.

Speed

Each sample was inserted between 2 sheets of intensifying screen K0-250, and exposed to light through an aluminum edge under conditions of a tube voltage of 80 kVp, a tube current of 100 mA and an irradiation time of 50 msec. Thereafter the exposed samples were processed on an automatic processor SRX-501 for 45 seconds using a 35° C. XD-SR developing solution and a 33° C. XF-SR fixing solution. On the samples thus processed, reciprocals of the amounts of exposure, required to obtain a density of base density + fog density + 1.0, were determined to give the stated sensitivities.

The speeds shown in Table 1 are indicated as relative speeds obtained when the speed of the sample No. 1 developed at 35° C. was assumed as 100.

As for sA, sA' and sB of each sample, they were determined in the fore-given procedure.

Measurement of MTF

With regard to each sample, a rectangular wave chart was photographed and MTF (modulation transfer function) was determined by the contrast method. The MTF was based on a value of a spatial frequency of 2.0 cycles/mm.

Fixing Performance Test

Each sample was immersed in a fixing solution (XF-SR) of 25° C., and the time by which silver halides have completely dissolved out was measured. In this measurement, poor fixing occurred in the 45 second processing when the time of dissolving-out exceeded 8 seconds. This is the level at which color changes occur in a long-term storage.

Processing Temperature Dependence

Like the speed test, samples were processed on the automatic processor SRX-501, using the developing solution XD-SR and the fixing solution XF-SR at development temperature of 32° C., 35° C. or 38° C. for 45 seconds. Sensitivity and contrast thus obtained on each sample were measured. The contrast indicates a gamma value of the line connecting the points of densities from 0.25 to 2.0 in the characteristic curve.

Amount of Remaining Organic Substance

This amount was shown as percentage of the remaining organic substance measured before and after processing by the film weight measuring method previously described.

Results obtained are shown in the following Table 1 together with the details of the samples.

As will be seen from Table 1, the samples according to the present invention undergo less variations in speed and contrast even when processing temperatures are changed, do not cause deterioration of fixing performance and can obtain images with high sharpness.

EXAMPLE 2

Tabular grains were prepared in the same manner as the method disclosed in Japanese Patent O.P.I. Publication No. 52137/1989. As the tabular grains, three kinds of those having a particle diameter of 1.2 μm (G), 0.7 μm (H) or 0.4 μm (I) were prepared. Emulsions comprising these grains were subjected to the same spectral sensitization and chemical sensitization as the emulsions (A), (B) and (C) in Example 1. Using these emulsions, the following coating solutions were prepared.

Coating solution 7:

Emulsions (G) to (I) were mixed in a proportion of (G):(H):(I)=10:60:30.

Coating solution 8:

Emulsions (G), (H) were mixed in a proportion of (G):(H)=25:75

Coating solution 9:

Emulsions (I)=100.

Coating solution 10:

Emulsions (D), (H) were mixed in a proportion of (D):(H)=20:80

Coating solution 11:

Emulsion (H)=100.

Subsequently, samples 17 to 32 were obtained in the same manner as in Example 1. Coating weights of the emulsions in samples 21 to 28 were 3.0 g/m$^2$ and 1.9 g/m$^2$, in terms of silver, on side A and side B, respectively. In samples 17 to 20 and 29 to 32, the coating weights were 2.3 g/m$^2$ in terms of silver on both sides.

On the samples thus obtained, the same tests as in Example 1 were carried out to obtain the results shown in Table 2.

As will be clear from Table 2, according to the present invention, images with a high speed and a high sharpness are stably obtained without causing deterioration of processing performance, even when the tabular grains are used.

TABLE 1

| | Coating solution Side | | | | | | | | | Fixing performance | 32° C. | | 35° C. | | 38° C. | | |
|---|---|---|---|---|---|---|---|---|---|---|---|---|---|---|---|---|---|
| No. | A | B | sA | sA' | sB | Polymeric subs. | Amount (g/m$^2$) | (1) (%) | MTF | (sec) | S* | C** | S* | C** | S* | C** | (2) |
| 1 | 1 | 1 | 100 | 95 | 100 | — | — | 98 | 50 | 6.5 | 80 | 2.25 | 100 | 2.40 | 115 | 2.65 | X |
| 2 | 1 | 1 | 110 | 105 | 110 | *K-1 | 0.4 | 85 | 50 | 5.0 | 95 | 2.30 | 110 | 2.45 | 125 | 2.60 | " |
| 3 | 1 | 1 | 110 | 105 | 110 | K-2 | " | 80 | 50 | 5.0 | 95 | 2.30 | 110 | 2.45 | 125 | 2.60 | " |
| 4 | 1 | 1 | 120 | 113 | 120 | K-3 | " | 86 | 50 | 4.8 | 105 | 2.35 | 120 | 2.45 | 130 | 2.60 | " |
| 5 | 2 | 3 | 170 | 35 | 30 | — | — | 98 | 60 | 7.5 | 70 | 2.00 | 100 | 2.45 | 130 | 2.65 | " |
| 6 | 2 | 3 | 188 | 40 | 34 | K-1 | 0.4 | 84 | 60 | 5.0 | 115 | 2.45 | 120 | 2.50 | 130 | 2.55 | Y |
| 7 | 2 | 3 | 188 | 40 | 34 | K-2 | " | 86 | 60 | 5.2 | 110 | 2.45 | 115 | 2.50 | 125 | 2.55 | " |
| 8 | 2 | 3 | 200 | 44 | 38 | K-3 | " | 82 | 60 | 4.8 | 110 | 2.40 | 120 | 2.45 | 125 | 2.50 | " |
| 9 | 4 | 4 | 120 | 100 | 120 | — | — | 95 | 55 | 6.3 | 90 | 2.25 | 120 | 2.40 | 140 | 2.70 | X |
| 10 | 4 | 4 | 134 | 108 | 134 | K-1 | 0.4 | 86 | 55 | 5.5 | 120 | 2.30 | 135 | 2.45 | 160 | 2.60 | " |
| 11 | 4 | 4 | 132 | 106 | 132 | K-2 | " | 88 | 55 | 5.5 | 115 | 2.35 | 135 | 2.45 | 155 | 2.60 | " |
| 12 | 4 | 4 | 140 | 112 | 140 | K-3 | " | 80 | 55 | 5.8 | 120 | 2.30 | 140 | 2.45 | 160 | 2.60 | " |
| 13 | 5 | 6 | 200 | 30 | 35 | — | — | 98 | 65 | 8.2 | 100 | 2.00 | 120 | 2.45 | 140 | 2.65 | " |
| 14 | 5 | 6 | 220 | 33 | 38 | K-1 | 0.4 | 80 | 65 | 5.5 | 130 | 2.45 | 140 | 2.50 | 145 | 2.50 | Y |
| 15 | 5 | 6 | 220 | 33 | 38 | K-2 | " | 83 | 65 | 5.2 | 130 | 2.40 | 140 | 2.50 | 145 | 2.50 | " |
| 16 | 5 | 6 | 230 | 36 | 40 | K-3 | " | 85 | 65 | 5.2 | 130 | 2.45 | 135 | 2.45 | 140 | 2.50 | " |

(1): Amount of remaining organic substances (2): Remarks

S*: Sensitivity; C**: Contrast

*K-1: Dextran; molecular weight: 70,000

K-2: Polyacrylamide; molecular weight: 70,000

K-3: Polyacrylic acid; molecular weight: 70,000

TABLE 1

| No. | Coating solution Side A | Coating solution Side B | sA | sA' | sB | Polymeric subs. | Amount (g/m²) | (1) (%) | MTF | Fixing performance (sec) | 32° C. S* | 32° C. C** | 35° C. S* | 35° C. C** | 38° C. S* | 38° C. C** | (2) |
|---|---|---|---|---|---|---|---|---|---|---|---|---|---|---|---|---|---|
| 17 | 7 | 7 | 100 | 85 | 100 | — | — | 89 | 55 | 6.0 | 85 | 2.30 | 100 | 2.45 | 115 | 2.60 | X |
| 18 | 7 | 7 | 110 | 95 | 110 | K-1 | 0.4 | 78 | 55 | 5.2 | 95 | 2.35 | 110 | 2.50 | 125 | 2.65 | " |
| 19 | 7 | 7 | 115 | 95 | 115 | K-2 | " | 80 | 55 | 4.8 | 100 | 2.35 | 115 | 2.50 | 125 | 2.65 | " |
| 20 | 7 | 7 | 120 | 100 | 120 | K-3 | " | 85 | 55 | 5.0 | 105 | 2.35 | 120 | 2.50 | 130 | 2.60 | " |
| 21 | 8 | 9 | 190 | 40 | 50 | — | — | 100 | 70 | 8.5 | 80 | 2.10 | 100 | 2.45 | 120 | 2.65 | " |
| 22 | 8 | 9 | 210 | 45 | 55 | K-1 | 0.4 | 86 | 70 | 6.0 | 115 | 2.45 | 120 | 2.50 | 125 | 2.55 | Y |
| 23 | 8 | 9 | 210 | 45 | 55 | K-2 | " | 84 | 70 | 5.5 | 110 | 2.50 | 115 | 2.55 | 120 | 2.55 | " |
| 24 | 8 | 9 | 210 | 45 | 55 | K-3 | " | 85 | 75 | 5.5 | 110 | 2.50 | 115 | 2.55 | 125 | 2.60 | " |
| 25 | 10 | 9 | 180 | 45 | 50 | — | — | 100 | 68 | 8.5 | 70 | 2.05 | 100 | 2.45 | 135 | 2.65 | X |
| 26 | 10 | 9 | 195 | 50 | 55 | K-1 | 0.4 | 85 | 70 | 5.0 | 105 | 2.45 | 115 | 2.50 | 120 | 2.55 | Y |
| 27 | 10 | 9 | 195 | 50 | 55 | K-2 | " | 82 | 68 | 4.8 | 110 | 2.50 | 120 | 2.55 | 125 | 2.60 | " |
| 28 | 10 | 9 | 200 | 50 | 55 | K-3 | " | 80 | 70 | 5.2 | 115 | 2.50 | 110 | 2.55 | 120 | 2.55 | " |
| 29 | 11 | 11 | 100 | 85 | 100 | — | — | 89 | 55 | 6.5 | 85 | 2.55 | 100 | 3.15 | 120 | 3.35 | X |
| 30 | 11 | 11 | 110 | 95 | 110 | K-1 | 0.4 | 86 | 55 | 5.0 | 95 | 2.85 | 110 | 3.15 | 135 | 3.25 | " |
| 31 | 11 | 11 | 120 | 105 | 120 | K-2 | " | 82 | 55 | 5.0 | 100 | 2.85 | 120 | 3.20 | 140 | 3.35 | " |
| 32 | 11 | 11 | 110 | 95 | 110 | K-3 | " | 80 | 55 | 5.0 | 95 | 2.75 | 110 | 3.20 | 125 | 3.35 | " |

What is claimed is:

1. A light-sensitive silver halide photographic material comprising a support having side A and side B, two photographic layers being provided on each of side A and side B, said two photographic layers comprising a silver halide emulsion layer and a hydrophilic colloid layer, wherein said light-sensitive material satisfies Formulas I and II, and at least one layer of said photographic layers contains dextran, polyacrylic acid, or polyacrylamide, each having an average molecular weight of not more than 80,000 and capable of flowing out of said photographic layer during processing of said light-sensitive material, whereby the organic substances remaining in said photographic layers after processing is present in an amount of not more than 90% by weight of the organic substances contained in the photographic layers before processing of said light-sensitive material;

I: $sA/sA' > 4.0$

II: $sA/sB = 1.5$ to 20 wherein sA is sensitivity to light of said photographic layers provided on the side A of said support, when exposure is carried out only from the side A; and sB and sA' are sensitivities to light of said photographic layers provided on the sides B and A of said support, respectively, when exposure is carried out only from the side B.

2. A material of claim 1, wherein said sensitivities of sA and sB have the following relationship;

$sA/sB = 1.5$ to 10

3. A material of claim 1, wherein said an average size of silver halide grains contained in the emulsion of side B is smaller than that of the emulsion layer of side A.

4. A material of claim 1, wherein the amount of said organic substance remained in said photographic layers after processing is 70% to 85% by weight of the organic substance contained in said photographic layers before processing.

5. A light-sensitive silver halide photographic material comprising a support having side A and side B, two photographic layers being provided on each of side A and side B, said two photographic layers comprising a silver halide emulsion layer and a hydrophilic colloid layer, wherein said light-sensitive material satisfies Formulas I and II, and at least one layer of said photographic layers contains dextran, polyacrylic acid, or polyacrylamide, each having an average molecular weight of not more than 80,000 and capable of flowing out of said photographic layer during processing of said light-sensitive material, whereby the organic substances remaining in said photographic layers after processing is present in an amount of not more than 90% by weight of the organic substances contained in the photographic layers before processing of said light-sensitive material;

I: $sA/sA' > 5.0$

II: $sA/sB = 1.5$ to 10 wherein sA is sensitivity to light of said photographic layers provided on the side A of said support, when exposure is carried out only from the side A, and sB and sA' are sensitivities to light of said photographic layers provided on the sides B and A of said support, respectively, when exposure is carried out only from the side B.

* * * * *